US006111178A

United States Patent [19]

Kile et al.

[11] Patent Number: 6,111,178

[45] Date of Patent: Aug. 29, 2000

[54] CHIME ASSEMBLY

[75] Inventors: Jeffrey L. Kile; Mark C. Kile, both of Mariposa; William L. Venturi, Oakhurst, all of Calif.

[73] Assignee: Grace Note Chimes, Incorporated, Mariposa, Calif.

[21] Appl. No.: 09/127,952

[22] Filed: Jul. 31, 1998

Related U.S. Application Data

[60] Provisional application No. 60/056,320, Aug. 14, 1997.

[51] Int. Cl.[7] ..... G10D 13/00

[52] U.S. Cl. ..... 84/403; 84/402

[58] Field of Search ..... 84/402–407; 116/148, 116/169

[56] References Cited

U.S. PATENT DOCUMENTS

| | | | |
|---|---|---|---|
| 1,100,671 | 6/1914 | Deagan . | |
| 2,206,837 | 7/1940 | Edwards | 84/405 |
| 2,278,126 | 3/1942 | McMullen | 84/403 |
| 2,559,334 | 7/1951 | Alexander . | |
| 2,820,431 | 1/1958 | Lescher . | |
| 4,237,767 | 12/1980 | Levine . | |
| 5,410,937 | 5/1995 | Okamoto et al. . | |
| 5,450,779 | 9/1995 | Yancy . | |

FOREIGN PATENT DOCUMENTS

| | | |
|---|---|---|
| 3836 279 C1 | 6/1990 | Germany . |
| 4265 | 12/1893 | United Kingdom . |

OTHER PUBLICATIONS

Marketing Brochure, "Where Heaven & Earth Meet", Grace Note Chimes, Mariposa, Calilfornia, 1993.

*Primary Examiner*—Robert E. Nappi
*Assistant Examiner*—Marlon T. Fletcher
*Attorney, Agent, or Firm*—Townsend and Townsend and Crew LLP

[57] ABSTRACT

A chime assembly (2) includes a plurality of tubular chimes (12) arranged in a straight or curved line. Each chime has a desired tone and is arranged in a series to create a non-scalar arrangement of said tones so that when the chimes are sound sequentially, a tune is created. The chime assembly includes a support frame (4) having upper and lower damping couplings (22,32). Each chime is mounted to a support rod (14) passing coaxially through the chime through the engagement of spring elements (34) engaging holes (44) formed at the nodal points of the chime. The ends of the support rod are supported by the upper and lower damping couplings. The damping couplings include grommets (30) circumscribing the support rod and damping foam (26) surrounding the ends of the support rod.

20 Claims, 4 Drawing Sheets

CHIME ASSEMBLY

CROSS-REFERENCE TO RELATED APPLICATION

This claims the benefit of and is a continuation-in-part of U.S. Provisional Patent Application No. 60/056,320 filed Aug. 14, 1997.

BACKGROUND OF THE INVENTION

Wind chimes are most commonly used to make pleasant background noise. One type of wind chime uses suspended hollow tubes as the individual chimes. The hollow tubes are most preferably supported by support structure contacting the tube at the nodal points, which for hollow tubes occur at two points, each spaced 22.5% of the total length from each end. Wind chimes, being at the mercy of the wind, do not actually play a tune, but rather create random or pseudo-random succession of tones.

Other tubular chime assemblies are used to permit a musician to play a tune. In these cases, the tubular chimes are arranged in a line in a scalar array of notes. See, for example, U.S. Pat. Nos. 1,100,671, 4,237,767 and 5,410,937.

SUMMARY OF THE INVENTION

The present invention is directed to a chime assembly having a plurality of chimes arranged in a line in a non-scalar arrangement of notes or other tones so that when the chimes are sounded sequentially, a tune is created. The chime assembly can be constructed to be suitable for outdoor placement.

The line of chimes may be straight, curved, or a combination of straight and curved segments. The chime assembly preferably includes a support frame supporting the ends of a support element, typically a support rod, by damping couplings. The damping couplings may include grommets circumscribing each support rod and damping foam surrounding the ends of the support rods.

The support elements preferably pass through the hollow tubular chimes. The support elements each have spring elements located to engage the inner surface of the chime at nodal points, thus supporting the chimes along the support element. The spring elements preferably include resiliently outwardly biased arms which engage holes formed in the chimes at the nodal points.

Other features and advantages will appear from the following description in which the preferred embodiments have been set forth in detail in conjunction with the accompanying drawings.

DESCRIPTION OF THE PREFERRED EMBODIMENTS

Figure 1:
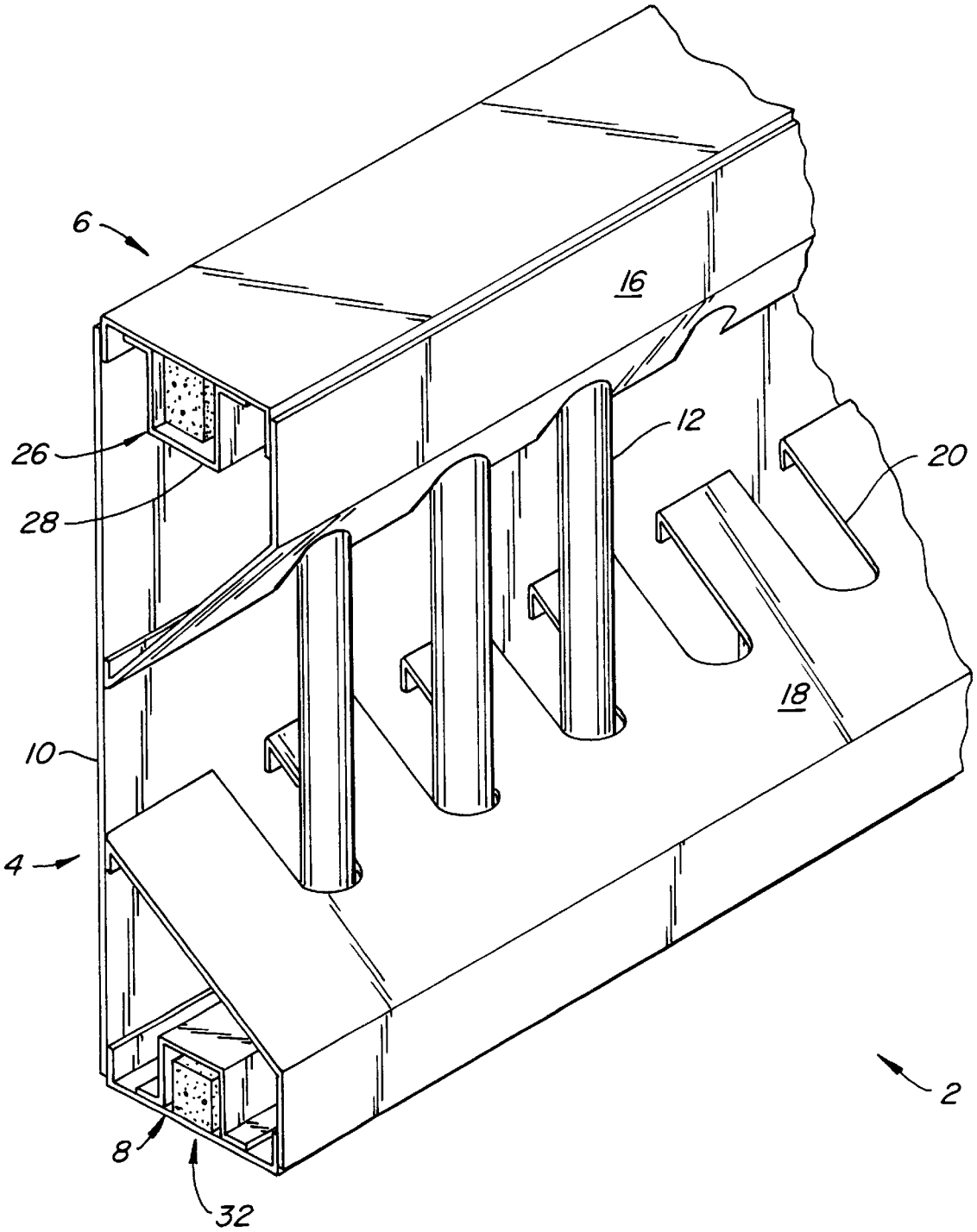
FIG. 1 is an overall view of one end of a chime assembly made according to the invention.

FIG. 1 illustrates a chime assembly 2 made according to the invention. Chime assembly 2 includes broadly a support frame 4 comprising an upper support 6 and a lower support 8 coupled together by a rear panel 10. Note that during the description of this embodiment, the terms upper, lower, and similar terms will be used. These terms are not used in a limiting sense, but only refer to the invention as shown in the enclosed drawings.

Figure 2:
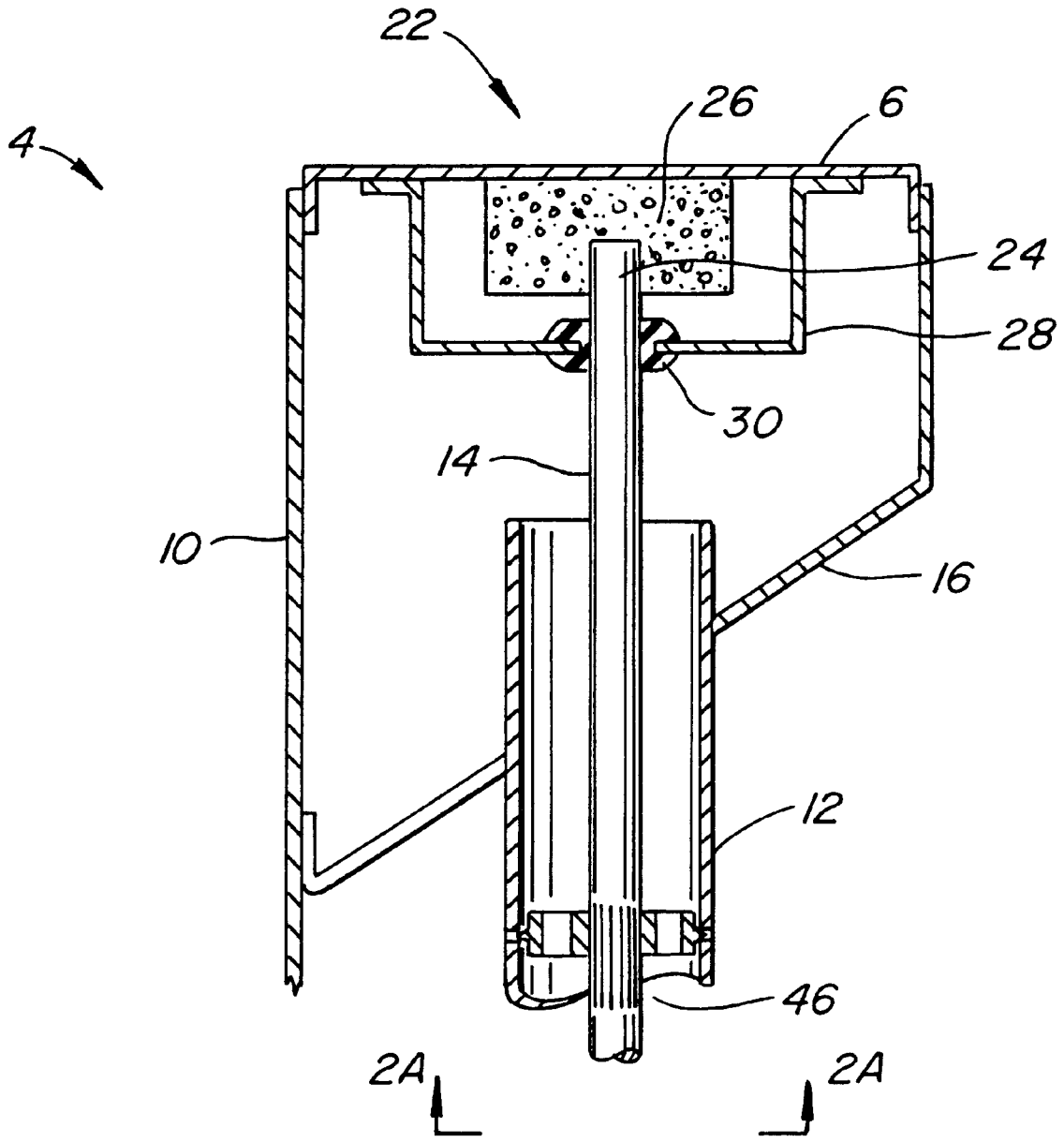
FIG. 2 is a partial cross-sectional view of the first or upper damping coupling and the upper mounting spring of the chime assembly of FIG. 2.
Figure 2A:
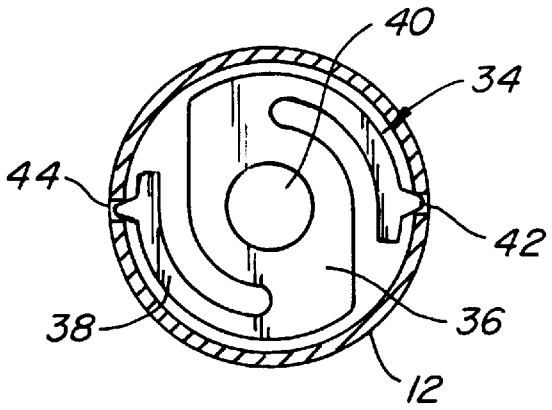
FIG. 2A is an enlarged cross-sectional view of the tubular chime taken along line 2A—2A of FIG. 2.
Figure 2B:
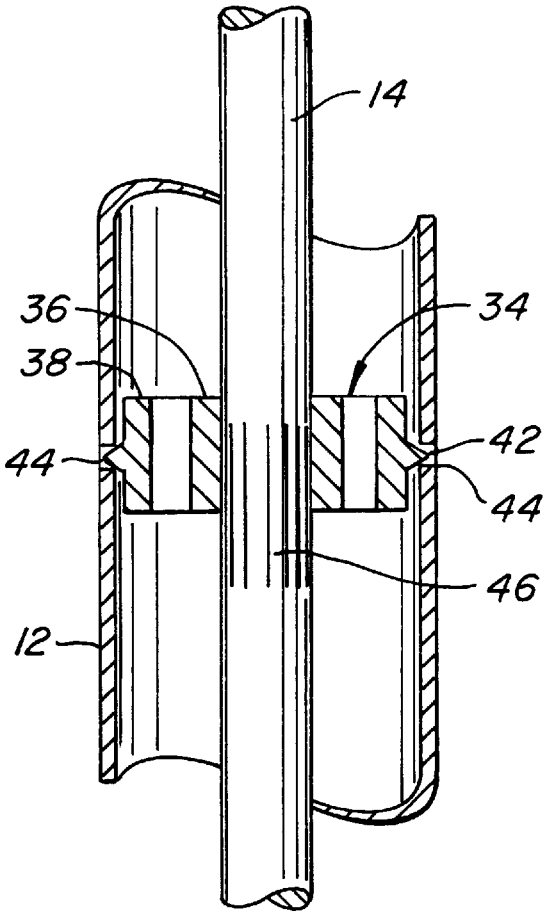
FIG. 2B is an enlarged partial vertical cross-sectional view of a central portion of the chime of FIG. 2.

A plurality of a hollow tubular chimes 12 are supported between upper and lower supports 6, 8 by a series of support rods 14 extending completely through the chimes. See FIG. 2. The mechanism for supporting chimes 12 on support rods 14 will be discussed below with reference to FIGS. 2, 2A and 2B. Chime assembly 2 also includes upper and lower guards 16, 18 secured to upper support 6, rear panel 10 and lower support 8 as shown in FIG. 2. Guards 16, 18 include a series of slots 20, see FIG. 1, through which chimes 12 pass. Upper and lower guards 16, 18 help to protect the mounting structure, discussed below, at upper and lower supports 6, 8 and also help to prevent children from climbing on chime assembly 2.

FIG. 2 illustrates an upper damping coupling 22 used to support the upper end 24 of support rod 14. Upper damping coupling 22 includes a block of damping foam 26 extending along the length of upper support 6. Damping foam 26 is preferably made of foam rubber available from C.I.R. of Fresno, Calif. Upper ends 24 of support rod 14 also pass through holes formed in a U-bracket 28; U-bracket 28 also extends along the length of upper support 6. Each hole in U-bracket 28 is fitted with an elastomeric grommet 30, such as one made of rubber by C.I.R. of Fresno, Calif., which snugly engages the circumference of support rod 14. Lower damping coupling 32 is similar to upper damping coupling 22 and extends along lower support 8 to support the lower ends of support rods 14.

Each chime 12 is secured to and suspended along support rod 14 by a pair of mounting springs 34. Mounting spring 34 is preferably made of acetal, such as that sold by DuPont of Wilmington, Dela. as Delrin®, but other materials could be used as well. Each mounting spring 34 includes a body 36 having a pair of resilient, radially-biased arms 38 and a bore 40 formed through the body. Each radial arm 38 has an extension or trunnion 42 at its distal end sized to engage a hole 44 formed through chime 12. Holes 44 are formed at the nodal points.

The use of springs 34 engaging holes 44 provides several advantages over conventional mounting techniques using pins through the chime. The spring, when made from a polymer, can be injection molded. Assembly is simplified because the actual engagement is achieved by trunnions 42 simply engaging holes 44. Proper positioning is assured because holes 44 are pre-formed at the nodal joints.

Nodal points can be determined experimentally or mathematically. The nodal points for tubular chimes 12 are at measured distances from each end of the chime, the distances equal to 22.5% of the total length of the chime. In the preferred embodiment, holes 44 are 0.125 inch in diameter and trunnions 42 are conical projections.

Upper-most mounting spring 34 is secured to support rod 14, typically by at interference fit over a slightly ribbed region 46 formed along support rod 14. The lower-most mounting spring 34 is snugly, but slidably, mounted along support rod 14 so that mounting springs 34 do not need to be located exactly at the precise intra-nodal distance and yet properly engage holes 44. This aids in assembly of assembly 2 because the lower-most mounting spring 34 can be secured to the lower-most set of holes 44, after which rod 14 can be positioned to engage trunnions 42 of the upper-most mounting spring 34 to the upper-most set of holes 44.

Chimes 12 are selected to sound particular notes or other tones. Chimes 12 are arranged along support frame 4 so that if chimes 12 are struck sequentially, the chimes create a non-scalar arrangement of notes or other tones, thus creating a tune. Thus, in use the chime assembly 2 can be used in an area where individuals passing the chime assembly can sequentially strike chimes 12 starting at one end to create the tune based on the arrangement of the tones created by the chimes. In the preferred embodiment, chime assembly 2 is in the form of a fence. It can be free-standing or mounted to a wall or other support structure. If desired, the chime assembly could be made so that chimes 12 are not in a straight line, but rather, for example, positioned along a circular arc. For example, a circular segment chime assembly could be used adjacent a carousel. Certain individuals on the carousel could be provided with strikers for engaging chimes 12 as the carousel rotates, thus creating the tune. Chimes 12 could be made of different colors, for example to create a rainbow of colors along the chime assembly or with each different note or other tone represented by a different color.

Figure 3:
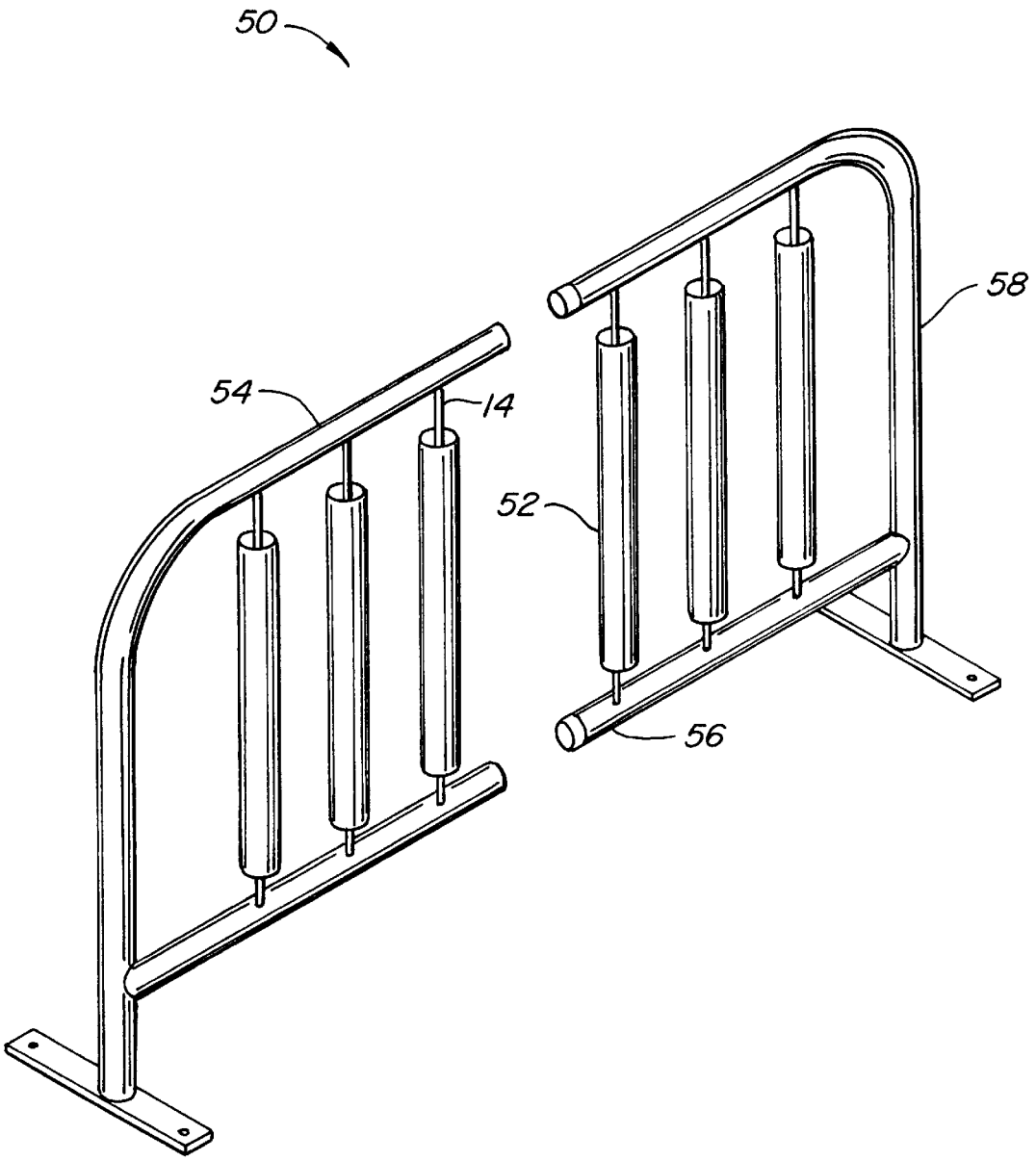
FIG. 3 is an overall view of an alternative embodiment of the chime assembly of FIG. 1.

FIG. 3 illustrates a simple barricade-type chime assembly 50. Each chime 52 is mounted between a pair of parallel bars 54, 56 by support rods 14 and mounting spring 34 as in the embodiment of FIGS. 1–2B. The bars are supported on each end by T-shaped stanchions 58. The connection between bars 54, 56 and stanchions 58 is preferably a type of clamping arrangement to permit chime assembly 50 to be easily disassembled into three major components: chimes, bars and stanchions. Chime assembly 50 could be made so that chimes 52 are in a non-scalar arrangement so that when chimes 52 are sounded sequentially, a tune is created. However, chime assembly 50 may also be made so that chimes 52 are in a scalar arrangement, that is in a musical scale, which permits the chimes to be played by a musician striking individual chimes. Chime assembly 50 lends itself to making each chime a different color, each color representing a note or other tone, to help children play a tune by striking the chimes color-by-color. Although not shown in FIG. 3, dummy tubular extension of chimes 52 are preferably mounted between each bar 54, 56 and the ends of each chime 52 to provide a more integrated look. To reduce the amount of damping caused by the dummy tubular extensions, a small gap, such as ¼ inch, can be provided between the opposed ends of the extensions and chimes. Also, the lengths of chimes 52 are preferably different according to the tune or scale desired. In such cases the shorter chimes would have longer dummy chime extensions than the longer chimes.

Chimes 12, 52 are preferably made from steel or aluminum, especially aluminum if the chime assembly is to be used outside. Typical diameters and lengths of chimes 12, 52 can vary from, for example, 12 inch to 0.60 inch lengths for 2 inch-diameter chimes, to 6 inch to 24 inch lengths for ⅝ inch diameter chimes. In one preferred embodiment chimes 12 are made from aluminum, are 1-⅜ inch diameter with a wall thickness of 1/16 inch and range in lengths from 16 inches to 36 inches.

Other modifications and variations can be made to the disclosed embodiments without departing from the subject of the invention as defined in the following claims. For example, chime assemblies 2, 50 could be played in conjunction with another musical instrument. Holes 44 need not extend completely through the wall of chime 12. Also, hole 44 could be created by, for example, a circular or circumferential recess formed in a projection extending inwardly from the inside wall of chime 12.

Each patent and application referred to above is incorporated by reference.

What is claimed is:

1. A chime assembly comprising:

a support frame having first and second portions spaced apart from one another;

a support element;

first and second damping couplings mounting said support element to and between said first and second portions of said support frame; and a chime mounted to said support element and between the first and second portions of the support frame.

2. A chime assembly as in claim 1 wherein said chime assembly is an outdoor device.

3. A chime assembly as in claim 2 wherein said chimes are arranged in a straight line.

4. A chime assembly as recited in claim 1 wherein:

said first portion of the support frame is vertically above said second portion of the support frame.

5. A chime assembly as recited in claim 4 further comprising:

a plurality of said chimes, said support elements and sets of said first and second damping couplings, said chimes each having a desired tone, said chimes arranged on the support frame in a non-scalar arrangement so that when the chimes are sounded sequentially, said arrangement of tones creates a tune.

6. A chime assembly comprising:

a hollow chime having an internal surface;

a support element extending along the internal surface;

a mounting spring assembly, secured to the support element, having first and second spring arms; and said spring arms of the mounting assembly having engagement elements engaging the internal surface of the chime to secure the chime to the support element.

7. A chime assembly as in claim 6 wherein:

the chime and support element are coaxial.

8. A chime assembly as in claim 7 wherein:

said support element is a support rod.

9. A chime assembly as in claim 6 wherein:

the mounting spring assembly circumscribes the support element.

10. A chime assembly as recited in claim 6 wherein:

said chime has a nodal point; and said mounting spring assembly engages the internal surface of the chime at the nodal point.

11. A chime assembly as recited in claim 6 wherein:

said chime has first and second spaced-apart spring arm engaging regions on said internal surface; and said chime is secured to the support element by first and second of said mounting spring assemblies engaging the chime at said first and second spring arm engaging regions.

12. A chime assembly as in claim 11 wherein:

said first spring arm engaging region comprises first and second recesses formed in the internal surface for engagement with the spring arm engagement elements of the first mounting spring arm.

13. A chime assembly as recited in claim 12 wherein:

said recesses comprise first and second through-holes formed through the chime.

14. A chime assembly as recited in claim 11 wherein:

said first mounting spring assembly is non-movably secured to said support element and the second mounting spring assembly is slidably mounted to the support element.

15. A chime assembly as recited in claim 6 wherein:

said spring arms have distal ends and said first and second spring arm engagement elements comprise extensions extending from the distal ends.

16. A chime assembly comprising:

a support frame having first and second portions;

a plurality of support elements;

first and second damping couplings mounting said support elements to said first and second portions of said support frame;

a plurality of hollow chimes each having an internal surface;

said support elements extending along the internal surfaces of said hollow chimes;

mounting spring assemblies secured to the support elements, each said mounting spring assembly having first and second spring arms;

said spring arms of the mounting assemblies having engagement elements engaging the internal surfaces of the chimes to secure the chimes to the support elements;

each said chime having a desired tone; and said chimes arranged in a line in a chosen series to create a non-scalar arrangement of said tones, whereby when said chimes are sounded sequentially, said arrangement of tones create a tune.

17. A chime assembly comprising:

a support frame having first and second portions;

a support element;

first and second damping couplings mounting said support element to said first and second portions of said support frame;

a chime mounted to said support element; and said first and second damping couplings comprising first and second resilient grommets between the support element and the first and second portions of the support frame.

18. A chime assembly as recited in claim 17 wherein:

said first and second grommets circumscribe the support element.

19. A chime assembly comprising:

a support frame having first and second portions;

a support element;

first and second damping couplings mounting said support element to said first and second portions of said support frame;

a chime mounted to said support element;

said support element having first and second ends; and said first and second damping couplings comprising damping foam surrounding said first and second ends of the support element.

20. A chime assembly as recited in claim 19 wherein:

said first and second damping couplings comprise first and second grommets supported by said first and second portions of the support frame and circumscribing the support element.

* * * * *